United States Patent [19]

Good

[11] 4,021,961

[45] May 10, 1977

[54] WHEEL MOUNTING FOR TOY VEHICLES

[75] Inventor: Thomas W. Good, Minnetonka, Minn.

[73] Assignee: Tonka Corporation, Hopkins, Minn.

[22] Filed: Jan. 14, 1976

[21] Appl. No.: 649,429

[52] U.S. Cl. ..... 46/201; 46/221

[51] Int. Cl.[2] ..... A63H 17/05

[58] Field of Search ..... 46/202, 221

[56] References Cited

UNITED STATES PATENTS

| | | | |
|---|---|---|---|
| 3,005,285 | 10/1961 | Girz | 46/221 |
| 3,238,666 | 3/1966 | Gigl | 46/221 |
| 3,653,149 | 4/1972 | Prodger et al. | 46/201 |

*Primary Examiner*—Louis G. Mancene
*Assistant Examiner*—Robert F. Cutting

[57] ABSTRACT

In a miniature toy vehicle a chassis extending in a fore and aft direction relative to the intended direction of travel, said chassis having a pair of transversely aligned downwardly opening notches and a hook member depending from the chassis between the notches and adapted to retain a wheel holding axle in said notches, said hook member being of flexible material and having a beveled bottom face allowing the axle to be forced upwardly into the notches and over the hook member.

3 Claims, 5 Drawing Figures

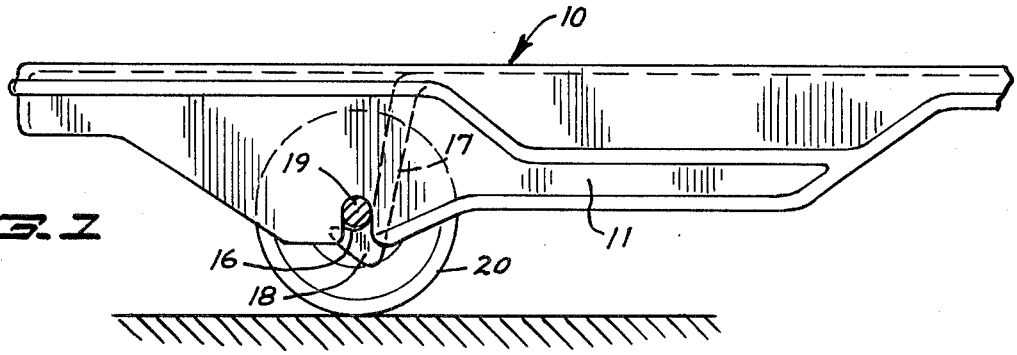
FIG. 1
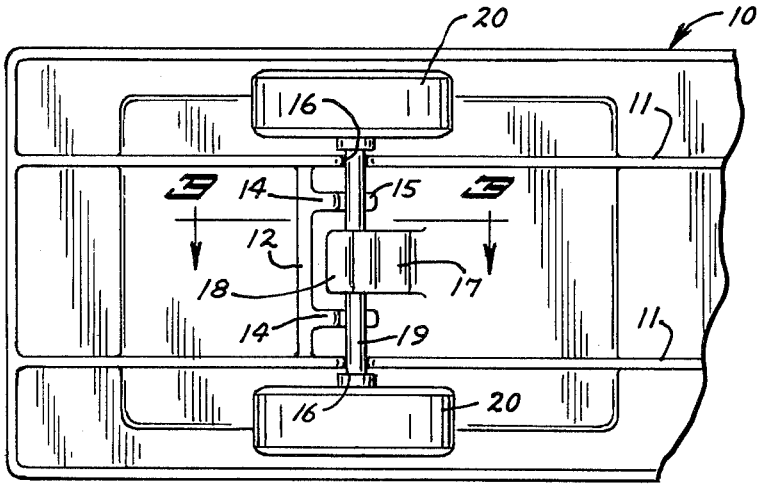
FIG. 2
FIG. 3
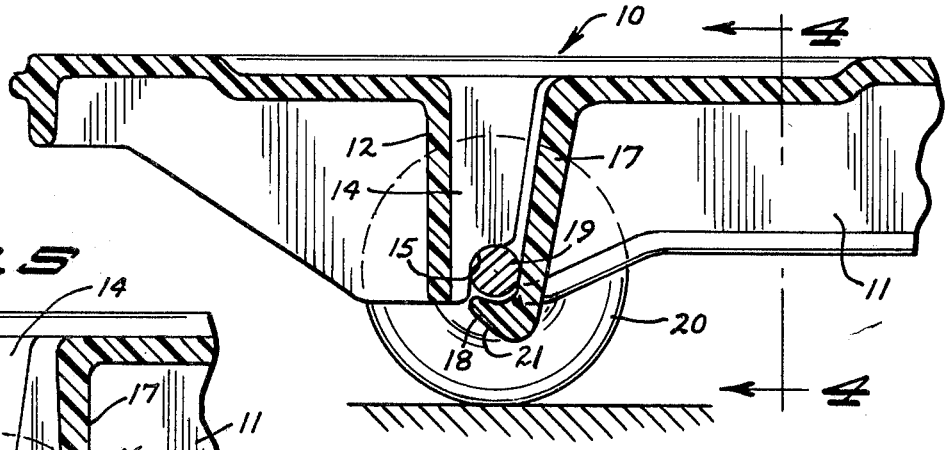
FIG. 5
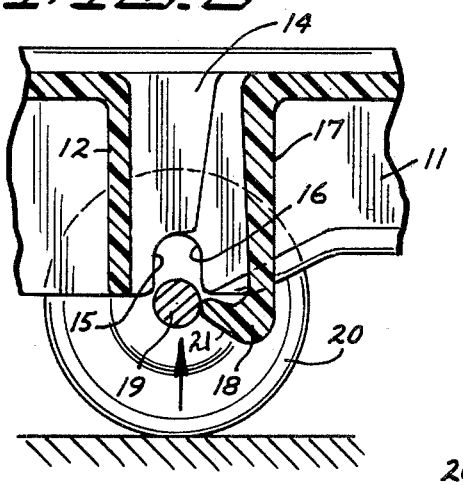
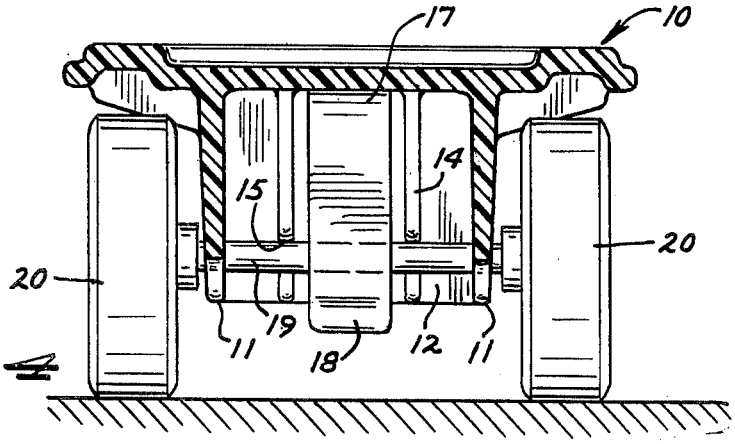
FIG. 4

WHEEL MOUNTING FOR TOY VEHICLES

BACKGROUND OF THE INVENTION

This invention relates generally to miniature toy vehicles and more particularly concerns the mounting of wheel and axle assemblies on the vehicle.

In the construction of miniature toy wheeled vehicles, the wheels are generally mounted on an axle which is journaled in side portions of the vehicle chassis or held in place by a pan extending under the chassis. While these types of wheel axle mounting are satisfactory they do involve considerable assembly time. Also, where the pan is used, the cost is substantially increased for a relatively inexpensive toy article.

The object of the present invention is to provide a new and improved axle mounting for a miniature toy vehicle which provides a highly rotatable journal for the axle and yet which can be assembled at a minimum parts and labor cost.

With this and other objects in mind the invention broadly comprises a chassis having a pair of flanges extending longitudinally thereunder in transversely spaced relation and having downwardly opening transversely aligned notches. A hook member extends downwardly from the chassis between the flanges with the hook portion thereof disposed in alignment with the notches to secure a wheel axle in the notches. The hook member is preferably integral with the chassis and is flexible so as to yield when the axle is forced into the notches.

BRIEF DESCRIPTION OF THE DRAWINGS

In the drawings:

FIG. 1 is a side elevation of a portion of a miniature toy vehicle chassis embodying the present invention with the near wheel removed but showing the retainer hook securing the wheel axle in the chassis.

FIG. 2 is a bottom plan view of the chassis portion shown in FIG. 1.

FIG. 3 is an enlarged longitudinal vertical section through the chassis taken on line 3—3 of FIG. 2.

FIG. 4 is a transverse vertical section through the chassis taken on line 4—4 of FIG. 3 and looking in the direction of the arrows.

FIG. 5 is a fragmentary section similar to FIG. 3 but showing the retainer hook in open position during insertion of the axle into the chassis.

DESCRIPTION OF THE PREFERRED EMBODIMENT

Referring now more particularly to the drawing reference numerals will be used to denote like parts or structural features in the different views. A miniature toy vehicle chassis is denoted generally at 10. This chassis is preferably molded of a rigid but somewhat flexible plastic material and has a pair of axle support beams or plates 11 extending longitudinally along the underside thereof in transversely spaced relation. A vertical cross plate 12 interconnects the beams 11. Plate 12 carries a pair of transversely spaced gussets 14 having seats 15 formed at the bottom thereof. These seats 15 are aligned with notches 16 in the beams 11. A hook member 17 depends from the chassis midway between the beams 11 with a latch portion 18 at its lower end. The latch 18 is positioned so as to jointly with seats 15 and notches 16 form a journal bearing for the axle 19 which carries ground wheels 20. The bottom surface 21 of the latch 18 is beveled upwardly toward the seats 15.

The gussets 14 are not essential to the wheel mounting as axle 19 may be secured by the notches 16 and member 17. However, the gussets are preferred as they not only assist in providing a bearing means for the axle but additionally in combination with wall 12 and hook member 17 provide a framework around the underside of the opening thereabove in the chassis 10 so that a small child cannot get his or her finger stuck in the opening or injured by the edges thereof.

A primary advantage in the structure described lies in the ease of assembly. With the wheels 20 being preconnected to the axle 19, the assembler merely holds the chassis 10, positions the axle 19 against the surface 21 of the hook member 17 and by pushing on the wheels 20 the axle 19 will slide along surface 21 forcing the member 17 to the position shown in FIG. 5 whereby the axle can slide over the latch portion 18 and into the seats 15 and notches 16. Member 17 being resilient then snaps back into the axle retention position best shown in FIG. 3.

While it is possible to remove the axle 19 by bending member 17 in a direction away from plate 12, this cannot normally be accomplished by small children who normally play with miniature toy vehicles.

The structure accordingly provides an economical and effective means for mounting wheels on miniature toy vehicles.

Having now therefore fully illustrated and described the invention, what I claim to be new and desire to protect by United States Letters Patent is:

1. In a miniature toy vehicle, a. an elongated chassis having a pair of transversely spaced portions with transversely spaced downwardly opening notches, b. a rigid axle member seated in said notches and carrying wheels at its ends, c. a hook member of resilient material formed integral with the chassis and depending therefrom between said transversely spaced portions on the chassis, d. said hook member having a latch portion positioned to releasably secure the wheel axle in said notches and e. at least one gusset carried by the chassis and depending adjacent the rigid axle member to limit its movement away from the axle-retaining action of said hook member.

2. The subject matter of claim 1 wherein a pair of gussets are provided on the underside of the chassis between said transversely spaced portions one on each side of the hook member, said gussets having seats transversely aligned with the notches to serve as bearing means for the axle and further securing the axle against displacement from the notches.

3. The subject matter of claim 2 wherein said gussets are mounted on a wall extending transversely between said transversely spaced portions on the opposite side of the axle from the hook portion whereby said portions, wall, gussets and hook member provide a protective framework substantially enclosing the axle.

* * * * *